United States Patent [19]

Tada et al.

[11] Patent Number: 4,558,821

[45] Date of Patent: Dec. 17, 1985

[54] TRIGGER-TYPE SPRAYER WITH INTEGRALLY FORMED HOUSING, TRIGGER, NOZZLE AND CYLINDER

[75] Inventors: Tetsuya Tada, Tokyo; Kazuyuki Kawamoto; Akihiko Yamada, both of Onoda, all of Japan

[73] Assignee: Canyon Corporation, Tokyo, Japan

[21] Appl. No.: 543,026

[22] Filed: Oct. 18, 1983

[30] Foreign Application Priority Data

Mar. 3, 1983 [JP] Japan ..... 58-34940
Jul. 27, 1983 [JP] Japan ..... 58-137387

[51] Int. Cl.[4] ..... B05B 9/043
[52] U.S. Cl. ..... 239/333; 239/383
[58] Field of Search ..... 239/329, 331, 333, 383; 222/474, 383, 324, 210, 214

[56] References Cited

U.S. PATENT DOCUMENTS 3,701,478 10/1972 Tada ..... 239/333
3,897,006 7/1975 Tada ..... 239/333
4,153,203 5/1979 Tada ..... 222/383
4,325,501 4/1982 Shay ..... 222/383
4,336,895 6/1982 Aleff ..... 222/207

FOREIGN PATENT DOCUMENTS 2495022 6/1982 France .

*Primary Examiner*—Andres Kashnikow
*Assistant Examiner*—Scott D. Malpede
*Attorney, Agent, or Firm*—Frishauf, Holtz, Goodman & Woodward

[57] ABSTRACT

A trigger-type sprayer according to the present invention sucks up, pressurizes and sprays a liquid contained in a container having a mouth portion. The sprayer is provided with a housing attached to the mouth portion of the container, a trigger rockably attached to one end portion of the housing, a nozzle formed on the trigger and having an orifice, a cylinder supported at the middle portion on the housing and capable of facing the orifice, a suction tube attached to the other end portion of the cylinder and connecting the interior of the cylinder and that of the container, a piston one end of which is connected to the nozzle and the other end of which is located in the cylinder, the piston slidably touching the inner surface of the cylinder, a primary valve for selectively connecting the suction tube and the cylinder, and a secondary valve for selectively connecting the cylinder and the piston. The housing, trigger, nozzle, cylinder and suction tube are integrally formed.

32 Claims, 20 Drawing Figures

PRIOR ART
FIG. 1
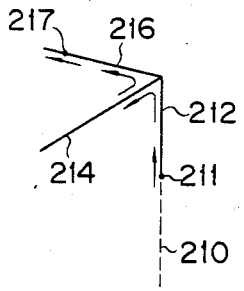
PRIOR ART
FIG. 2
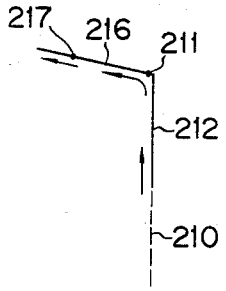
FIG. 3
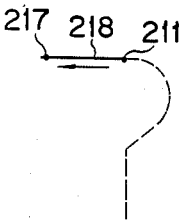
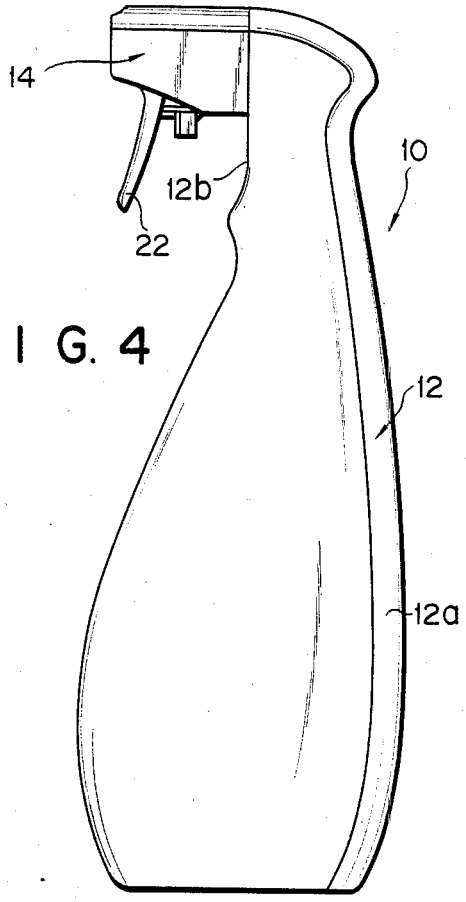
FIG. 4
FIG. 5
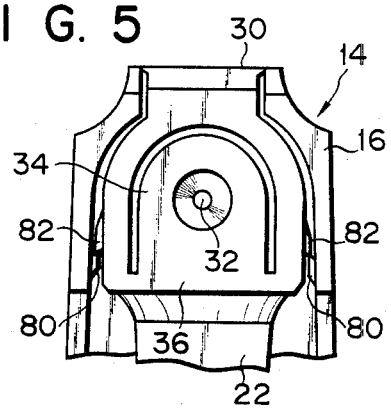

TRIGGER-TYPE SPRAYER WITH INTEGRALLY FORMED HOUSING, TRIGGER, NOZZLE AND CYLINDER

BACKGROUND OF THE INVENTION

The present invention relates to a trigger-type sprayer in which a piston is reciprocated by rocking a trigger, whereby a liquid in a container is sucked up, pressurized and sprayed.

Sprayers of this type have a sprayer body which is attached to a mouth portion of a container. These conventional trigger-type sprayers are classified into two groups, three-way trigger type sprayers (FIG. 1) and two-way trigger type sprayers (FIG. 2), depending on the number of passages formed in the sprayer body.

In a three-way trigger type sprayer (hereinafter referred to as simply "three-way sprayer"), a liquid in the container flows through a vertical passage 212 via a suction tube 210 and a primary valve 211, and then flows into a slant passage 214. As a piston associated with a trigger is forced into the slant passage 214 by rocking the trigger, the liquid in the slant passage 214 is pressurized and flows into a horizontal passage 216. Then, passing through a secondary valve 217, the liquid is sprayed through an orifice of a nozzle.

In a two-way trigger type sprayer (hereinafter referred to as simply "two-way sprayer"), there is no slant passage, and the piston is disposed in the horizontal passage 216. Thus, the liquid passed through the suction tube 210 and the vertical passage 212 flows into the horizontal passage 216 via the primary valve 211. Then, the liquid is pressurized by the reciprocating piston, and is sprayed through the secondary valve 217 and the orifice.

A cylinder, which constitutes a pump mechanism in conjunction with the piston, is formed in the slant passage (in the case of three-way sprayer) or horizontal passage (in the case of two-way sprayer) of the sprayer body. The trigger is formed independently of the sprayer body, and is rockably attached thereto.

In the three-way sprayer, the direction in which the piston is pushed in is not in line with the direction of the flow of the pressurized liquid. Namely, the pressurized liquid flows into the horizontal passage from the slant passage where it is compressed, thus changing its course or flowing direction. Therefore, a component of the liquid pressure will be transmitted to the sprayer body, resulting in a liquid pressure drop. Further, the three-way sprayer of this type, which has many passages therein, is complicated in structure and relatively high in manufacturing cost, requiring a lot of components or members.

In the two-way sprayer, on the other hand, the moving direction of the piston coincides with the flowing direction of the pressurized liquid, so that no pressure drop takes place. Moreover, the two-way sprayer requires only a relatively small number of components, which leads to a reduction in manufacturing cost.

In view of the actual technological competition, however, it is necessary further to reduce the number of components used in the sprayer for lower manufacturing cost. The conventional two-way sprayer is insufficient to meet these demands.

SUMMARY OF THE INVENTION

The object of the present invention is to provide a trigger-type sprayer using a minimum number of components therein for simpler construction, thus enjoying very low manufacturing costs.

In order to attain the above object, a trigger-type sprayer according to the present invention is constructed so that part of a container corresponds to the sprayer body used in the prior art sprayer, and has no passages therein. The housing of a pump mechanism is integrally formed with a trigger and a cylinder, and is attached to that part of the container which corresponds to the sprayer body. A nozzle is formed integrally on the trigger. Thus, according to the present invention, there is provided a trigger-type, one-way sprayer which has a single passage defined by a cylinder, that is, the horizontal passage 218, as shown in FIG. 3.

BRIEF DESCRIPTION OF THE DRAWINGS

FIGS. 1 to 3 are diagrams schematically showing prior art three- and two-way sprayers of a triger type and a trigger-type one-way sprayer according to the present invention, respectively;

FIGS. 4 and 5 are a side view and a partial front view, respectively, showing a trigger-type sprayer of a first embodiment according to the invention;

FIG. 11 is a sectional side view of the sprayer of the first embodiment, in which the trigger is pushed in;

DETAILED DESCRIPTION OF THE PREFERRED EMBODIMENTS

A trigger-type sprayer of a first embodiment according to the present invention will now be described in detail with reference to the accompanying drawings of FIGS. 4 to 11.

As shown in FIG. 4, a trigger-type, one-way sprayer 10 of the first embodiment comprises a container 12 and a pump mechanism 14 attached thereto.

Figure 6:
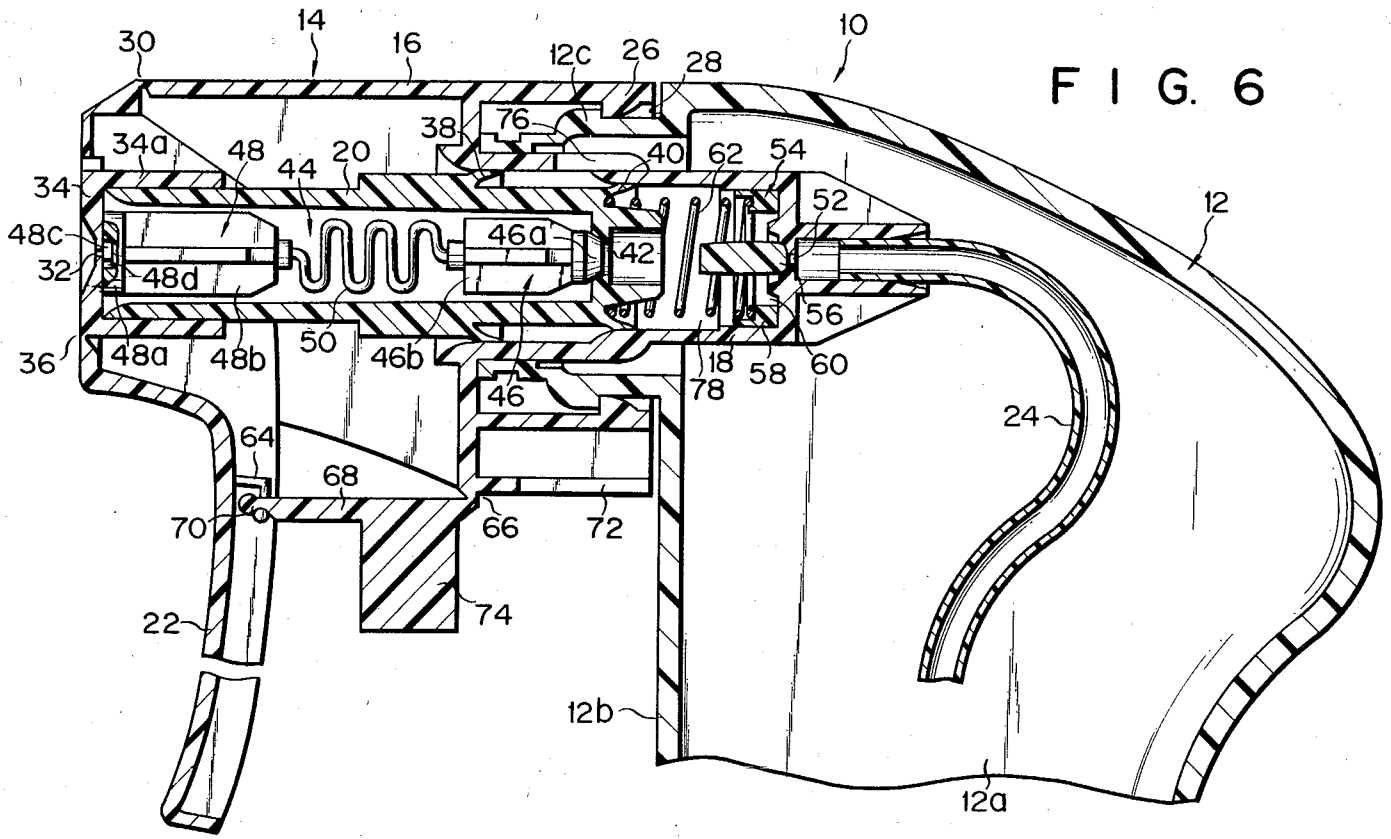
FIG. 6 is a sectional side view of the sprayer of the first embodiment, in which a trigger is locked.

As seen from FIGS. 4 to 6, the container 12 includes a vertically extending container body **12*a* and a horizontally extending mouth portion 12*c* fixed to one lateral face 12*b* formed of an upright surface at the upper portion of the container body 12*a*. Thus, the mouth portion 12*c* of the container 12** opens sideways.

Figure 7:
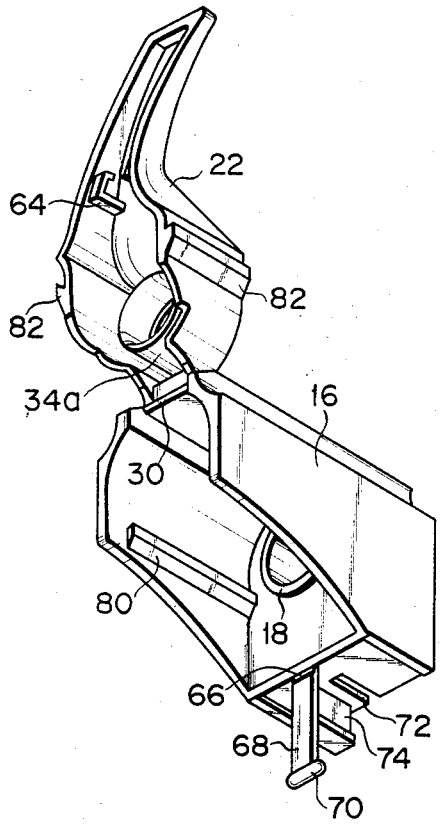
FIG. 7 is a perspective view showing a housing of a pump mechanism.

As seen from FIG. 6, the pump mechanism 14 includes a housing 16 attached to the mouth portion 12c of the container 12, a cylinder 18 defining a horizontal passage, a piston 20 reciprocating in the cylinder 18, and a trigger 22. One end of a suction tube 24 is attached to the rear end of the cylinder 18 in communicating relation. The other end of the suction tube 24 curvedly extends toward the bottom of the container 12. The suction tube 24 may be attached vertically or in the direction perpendicular to the axis of the cylinder 18. In veiw of fabricability, however, the suction tube 24 is preferably attached horizontally or along the axis of the cylinder 18, as shown in FIG. 6. The housing 16, cylinder 18 and trigger 22 are formed integrally, as shown in FIG. 7. The cylinder 18 is attached to the middle portion of the housing 16 so as to be housed therein. In such an arrangement that the pump mechanism 14 is attached directly to the container 12, a clamp ring and sprayer body, which are essential to the arrangement of the prior art sprayer, can be omitted to simplify the structure of the sprayer 10. The housing 16 has an engaging projection 26 for preventing disengagement, while the mouth portion 12c is provided with a recess 28 to receive the projection 26 therein.

As seen from FIG. 6, moreover, the trigger 22 is formed integrally with the housing 16, attached to the upper front portion thereof by means of a thin-walled hinge 30 for rocking. Thus, as compared with the conventional arrangement in which a trigger is formed independently of a cylinder, the arrangement of FIG. 6 is simplified, reduced in the number of independent members required. A nozzle 34 having an orifice (jet) 32 in the center is formed integrally with the trigger 22. Thus, the structure is additionally simplified. The lower end edge of the nozzle 34 is rockably mounted on the trigger 22 by means of a thin-walled hinge 36.

The piston 20 of the pump mechanism 14 has a front portion closely fitted in a cylindrical portion 34a of the nozzle 34 and a rear portion fitted in the cylinder 18. Sealing skirts 38 and 40 are formed on the middle and rear end portions, respectively, of the outer peripheral surface of the piston 20, slidably touching the inner surface of the cylinder 18. The piston 20 is in the form of a hollow cylinder which is open on the front end face and has a narrow aperture 42 in the rear end face. A secondary valve 44 is contained in the piston 20. The secondary valve 44 integrally comprises a secondary valve plug 46 capable of blocking the aperture 42, a spinner 48 abutting against the back of the nozzle 34, and a spring portion 50 interposed between the secondary valve plug 46 and the spinner 48. The spring portion 50 urges the secondary valve plug 46 to block the aperture 42 and the spinner 48 to abut against the nozzle 34.

Figure 8:
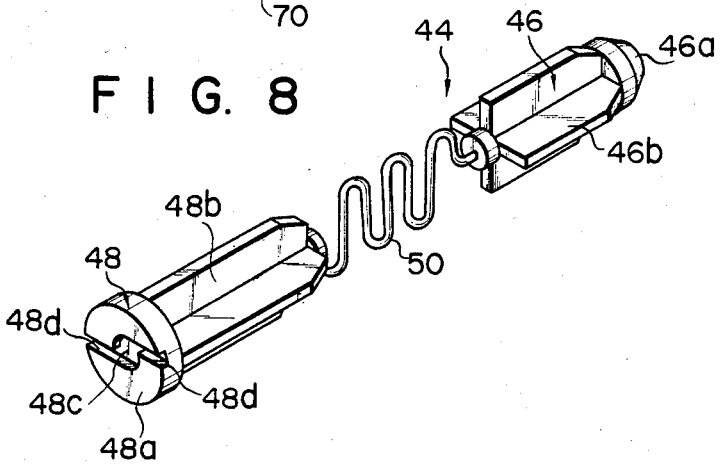
FIG. 8 is a perspective view showing a secondary valve.

As shown in FIG. 8, the secondary valve 44 is integrally formed. The secondary valve plug 46 includes a plug body portion 46a capable of being fitted in the aperture 42 and a guide portion 46b formed of four blades radially extending from the axis of the secondary valve 44. The spinner 48 includes a discoid body 48a and a guide portion 48b formed of four blades radially extending from the axis of the secondary valve 44.

A central circular recess 48c and a parallel pair of passages 48d tangentially extending from the recess 48c are formed in the front face of the spinner body 48a. Since the tangential passages 48d are open in front, the spinner 48 cannot independently fulfill its function. When the spinner 48 abuts against the nozzle 34, however, the passages 48d are blocked in front, so that the spinner 48 can fulfill its function. Thus, a pressurized liquid is swirled through the passages 48d, and sprayed through the recess 48c and the orifice 32.

An aperture 52 connecting with the suction tube 24 is formed in the central portion of the rear wall of the cylinder 18. A primary valve 54 is mounted in the rear portion of the interior of the cylinder 18. As extractively shown in FIG. 9, the primary valve 54 comprises a primary valve plug 56 capable of blocking the aperture 52, a ring portion 58 coaxial with the primary valve plug 56 and fitted in the cylinder 18, and three equiangular arms 60 extending circumferentially and coupling the primary valve plug 56 and the ring portion 58. In the primary valve 54 of this construction, the primary valve plug 56 is normally biased by the elastic force of the arms 60 to seal the aperture 52. Since the arms 60 extend circumferentially, however, the primary valve plug 56 can move along the axis of the piston 20 so as to be removed from the aperture 52.

A compression coil spring 62 is contained in the cylinder 18. The front end of the compression coil spring 62 engages the rear end of the piston 20, while the rear end of the spring 62 engages the front end of the ring portion 58 of the primary valve 54. Thus, the compression coil spring 62 urges the piston 20 to be forced out of the cylinder 18, and the primary valve 54 to be pressed against the rear wall of the cylinder 18.

Figure 10:
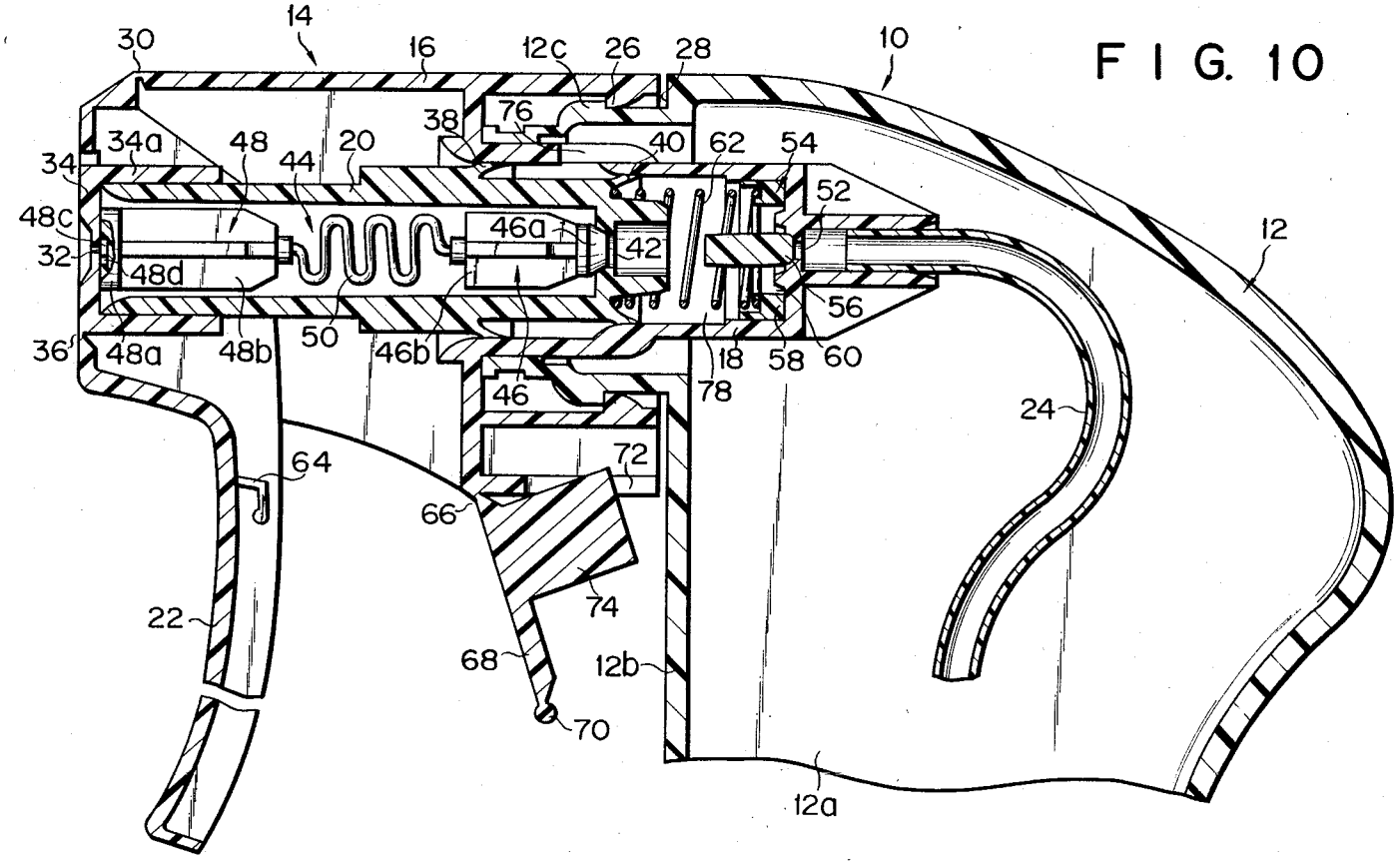
FIG. 10 is a sectional side view of the sprayer of the first embodiment, in which the trigger is unlocked.

An inverted-L-shaped engaging portion 64 is formed on the back of the trigger 22. A support bar 68 is integrally rockably attached to the lower end portion of the housing 16 by means of a hinge 66. A pin-shaped latch portion 70 capable of engaging with the engaging portion 64 is formed at the tip end of the support bar 68. The trigger 22 is prevented from rocking or is locked when the latch portion 70 is coupled to the engaging portion 64, as shown in FIG. 6. A lug 74 is formed on one side of the support bar 68. The lug 74 is capable of being inserted and held in a slit 72 formed in the wall of the housing 16. When the lug 74 is in the slit 72, as shown in FIG. 10, the support bar 68 allows the trigger 22 to rock freely.

Figure 11:
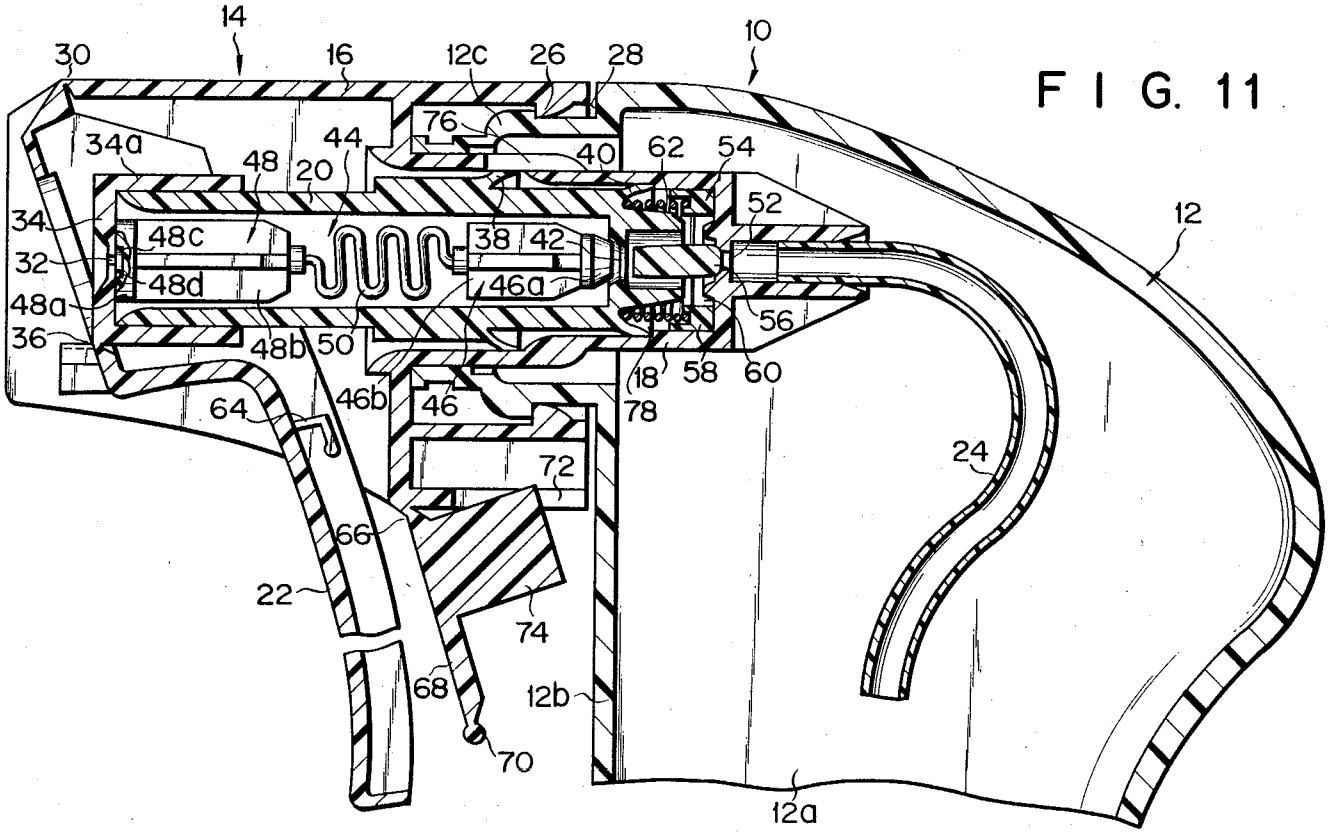

A negative pressure preventing hole 76 is formed at the front portion of the cylinder 18. The negative pressure preventing hole 76 communicates with the body 12a of the container 12 by means of the interior of the mouth portion 12c. when the trigger 22 is not pulled or depressed, the negative pressure preventing hole 76 is located between the two sealing skirts 38 and 40, as shown in FIG. 6. When the trigger 22 is depressed, the front sealing skirt 38 reaches the negative pressure preventing hole 76, as shown in FIG. 11. Thus, when the trigger 22 is pulled, the interior of the container 12 is connected with the outside air by means of the negative pressure preventing hole 76. That portion of the internal space of the cylinder 18 which is located behind the piston 20 is defined as a compression chamber 78.

As shown in FIGS. 5 and 7, two sets of engaging ridges 80 and 82 are formed integrally on the inner surface of the housing 16 and the outer surface of the trigger 22, respectively, to prevent the trigger 22 from excessively rocking. The engaging ridges 80 and 82 of each set mesh with each other so that the trigger 22 is allowed to rock counterclockwise around the hinge 30 from the position shown in FIG. 7, and is prevented from rocking clockwise (as in FIG. 7) from the position shown in FIG. 5. Thus, with use of the engaging ridges 80 and 82 arranged in this manner, the trigger 22 can be held so as to be rockable around the hinge 30 between the undepressed position shown in FIGS. 6 and 10 and the depressed position shown in FIG. 11.

The operation of the sprayer 10 constructed in this manner will now be described in detail.

During transportation or on display in a shopwindow, the latch portion 70 of the support bar 68 is engaged with the engaging portion 64 of the trigger 22, as shown in FIG. 6. In this state, the trigger 22 is prevented from rocking by the support bar 68 even if it is subjected to an urging force to rock it counterclockwise around the hinge 30. Accordingly, the trigger 22 will never carelessly be rocked, so that unwanted spraying will securely be avoided. Namely, the support bar 68 constitutes a child-proof mechanism. In this embodiment, the child-proof mechanism is formed integrally with the pump mechanism 14, ensuring a very simple structure. It is to be understood that the child-proof mechanism not only serves as a virgin lock, but also can be used when the spraying operation is suspended.

Figure 9:
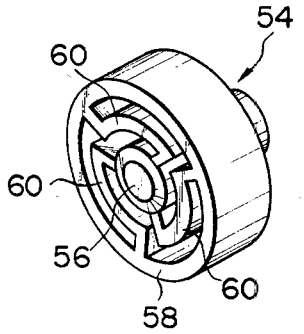
FIG. 9 is a perspective view showing a primary valve.

In use, the latch portion 70 is disengaged from the engaging portion 64, and the support bar 68 is rocked counterclockwise around the hinge 66 so that the lug 74 is fitted and locked in the slit 72 of the housing 16, as shown in FIG. 9. Locked in this manner, the support bar 68 will never prevent the trigger 22 from rocking. If the trigger 22 is pulled, it is rocked around the hinge 30 against the urging force of the coil spring 62. As the trigger 22 is rocked, the piston 20 is forced into the cylinder 18, so that the capacity of the compression chamber 78 in the cylinder 18 is reduced.

At this juncture, only the lower edge of the nozzle 34 is connected to the housing 16 by means of the hinge 36, while the upper edge is left free. Accordingly, the nozzle 34 can maintain its substantially vertical position without following the rocking action of the trigger 22. Thus, the piston 20 is forced into the cylinder 18, maintaining the substantially horizontal position.

If the urging force on the trigger 22 is removed thereafter, the piston 20 and the trigger 22 are returned to their respective initial positions shown in FIG. 9 by the biasing force of the coil spring 62. As a result, the capacity of the compression chamber 78 increases, so that a negative pressure is produced in the compression chamber 78. Accordingly, the primary valve 54 is opened against the uring force of the arms 60, so that a liquid in the container 12 flows into the compression chamber 76 through the suction tube 24 and the primary valve 54, sucked by the negative pressure in the compression chamber 78. The primary valve 54 blocks the aperture 52 the moment the liquid ceases to flow into the compression chamber 76. The secondary valve 44 is kept fully liquid-tight, since it is closed by the biasing force of the coil spring 50 as well as the negative pressure in the compression chamber 78.

As the liquid is sucked up into the compression chamber 78 through the suction tube 24, the liquid remaining in the container 12 is decreased, possibly producing a negative pressure in the container 12. When the piston 20 is forced into the cylinder 18, however, the sealing skirt 38 goes beyond the negative pressure preventing hole 76 of the cylinder 18, as shown in FIG. 11. Thus, the interior of the container 12 communicates with the outside air by means of the negative pressure preventing hole 76, thereby preventing the production of a negative pressure in the container 12.

Thereafter, if the trigger 22 is rocked again in the counterclockwise direction around the hinge 30, the piston 20 moves into the cylinder 18. As the trigger 22 is further rocked, the piston 20 goes deeper into the cylinder 18 to pressurize the liquid in the compression chamber 78. When the pressure of the liquid surpasses the biasing force of the spring portion 50 of the secondary valve 44, the secondary valve plug 46 is removed from the aperture 42 to open the secondary valve 44. Thereupon, the second valve plug 46 urges the spinner 48 so that the front of the spinner 48 abuts against the nozzle 32 to close the front of the tangential passages 48*d* (FIGS. 6 and 8). Therefore, the pressurized liquid flowing out through the aperture 42 flows into the passage 48*d* to be swirled thereby. Then, the swirled liquid is sprayed through the orifice 32. Thereafter, when the urging force on the trigger 22 is removed, the liquid in the container 12 is sucked up into the compression chamber 78 for the next cycle of spraying operation. The next cycle is started by pulling the trigger 22.

The sprayer 10 can be used as a dispenser if the spinner 48 is removed therefrom. It can also be used as a foamer whereby the liquid swirled and sprayed through the orifice 32 is dashed against foaming means such as a barrier to be foamed thereon. Moreover, the sprayer 10 may have a construction such that the pump mechanism 14 is attached to not the lateral but the top of the container 12 so that the piston 18 is reciprocated vertically.

According to the present invention, as described above, a cylinder and a trigger are integrally attached to the middle portion and the other end portion of a housing, respectively, while the mounting portion of a suction tube is attached to one end portion of the cylinder. A nozzle is formed integrally on the trigger. In this arrangement, the conventionally used spray body is omitted, and the trigger and nozzle, which have conventionally been independent members, are formed integrally with the cylinder. Thus, the structure is simplified, and the number of independent components required is reduced. Also, assembly work is facilitated, lowering manufacturing cost. According to the invention, moreover, there may be provided a new-type sprayer, that is, a one-way sprayer which maintains the advantages of a two-way sprayer.

Although an illustrative embodiment of the present invention has been described in detail herein with reference to the accompanying drawings, it is to be understood that the invention is not limited to the precise embodiment, and that various changes and modifications may be effected therein by one skilled in the art without departing from the scope or spirit of the invention.

A trigger-type sprayer according to a second embodiment of the present invention will now be described in detail with reference to the accompanying drawings of FIGS. 12 to 20.

Figure 12:
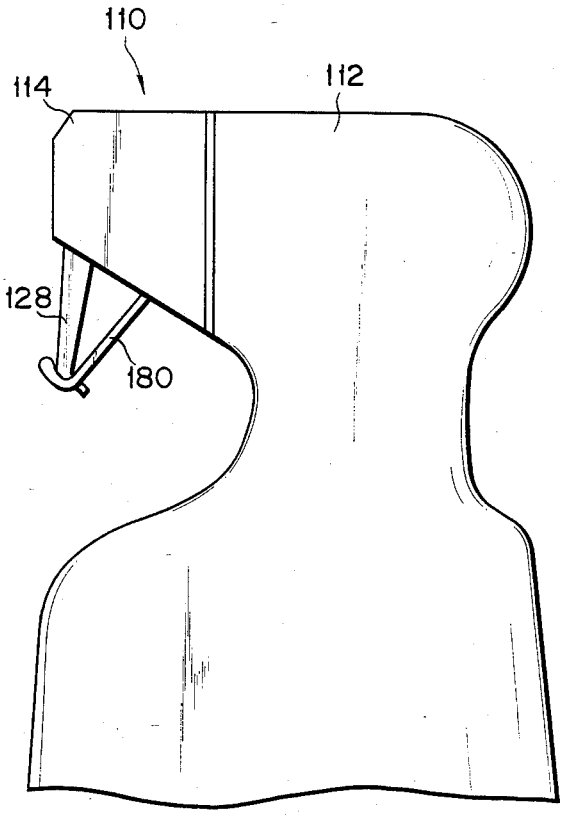
FIGS. 12 and 13 are a partial side view and a partial front view, respectively, showing a trigger-type sprayer of a second embodiment according to the invention.
Figure 13:
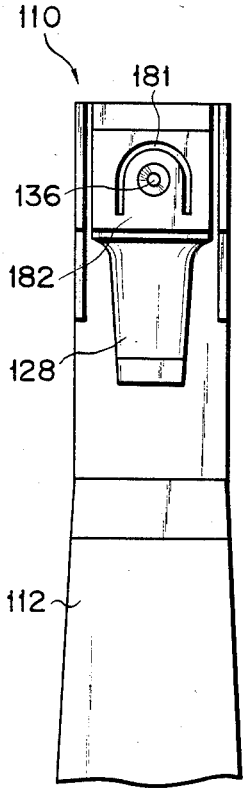
Figure 14:
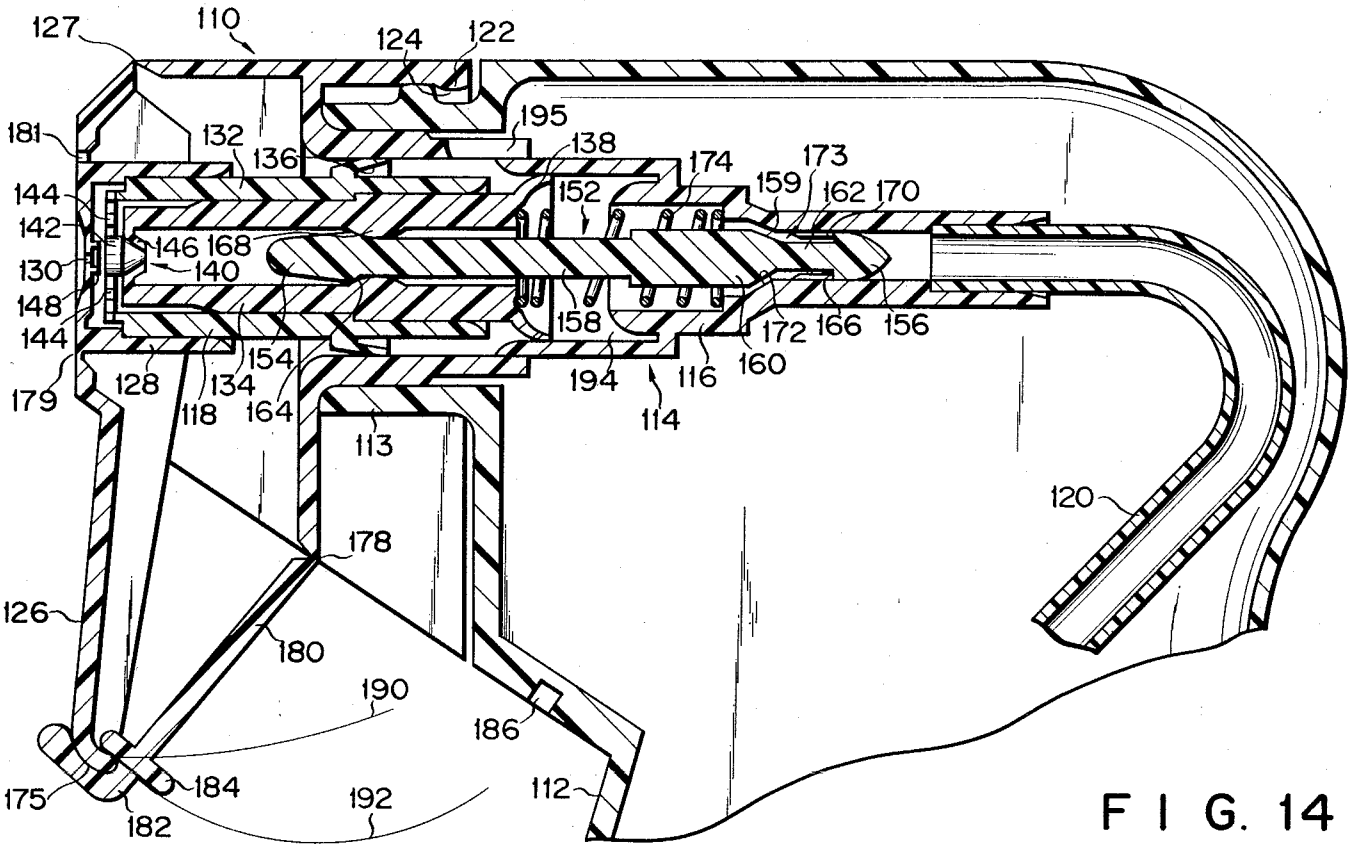
FIGS. 14 and 19 are partial sectional views shwoing the trigger-type sprayer of the second embodiment, in which a piston is in its initial position (projected position) and depressed position, respectively.
Figure 15:
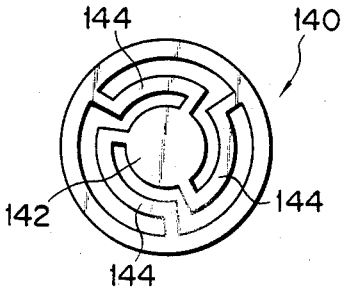
FIG. 15 is a front view of a secondary valve.
Figure 16:
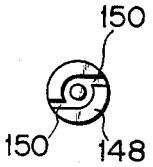
FIG. 16 is a rear view of a spinner of a nozzle.
Figure 17:
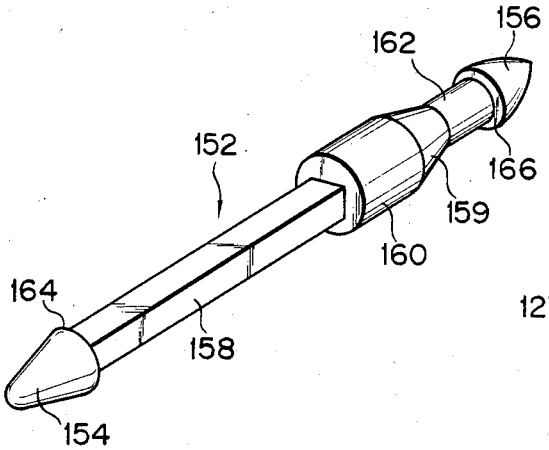
FIG. 17 is a perspective view of a valve rod.

As shown in FIGS. 12 to 14, a trigger-type, one-way sprayer 110 of the second embodiment according to the present invention comprises a container 112 and a pump mechanism 114 attached thereto.

As seen from FIG. 14, the pump mechanism 114 includes a cylinder 116 defining a horizontal passage and a piston 118 reciprocating in the cylinder 116. One end of a suction tube 120 is attached to one end of the cylinder 116. The other end of the suction tube 120 curvedly extends toward the bottom of the container 112. The suction tube 120 may be attached in the direction perpendicular to the axis of the cylinder 116. In veiw of fabricability, however, the suction tube 120 is preferably attached along the axis of the cylinder 116. The pump mechanism 114 is secured to the container 112 with the other end of the cylinder 116 fitted in a mouth portion 113 of the container 112.

In such an arrangement that the pump mechanism 114 is attached directly to the container 112, the clamp ring and sprayer body, which are essential to the arrangement of the prior art sprayer, can be omitted to simplify the structure of the sprayer 110. Numerals 122 and 124 designate a projection on the cylinder 116 and a hole in the mouth portion 113, respectively, for preventing disengagement.

As seen from FIG. 14, moreover, a trigger 126 is formed integrally with the cylinder 116, attached to the other end thereof by means of a hinge 127 for rocking. Thus, as compared with the conventional arrangement in which the trigger is formed independently of the cylinder, the arrangement of FIG. 14 is simplified, reduced in the number of independent members required. A nozzle 128 is formed integrally with the trigger 126, so that the structure is additionally simplified.

The piston 118 of the pump mechanism 114 includes a first piston portion 132 fitted in the nozzle 128 and a second piston portion 134 fitted in the first piston portion 132. The first and second piston portions 132 and 134 have on the outer peripheral surfaces thereof sealing skirts 136 and 138, respectively, in sliding contact with the inner surface of the cylinder 116. A secondary valve 140 is formed integrally on the front end of the first piston portion 132. A valve plug 142 of the secondary valve 140 is coupled to the first piston portion 132 by means of three flexible arms 144 arranged in an equiangular manner (see FIG. 15). Normally, therefore, the valve plug 142 is pressed against a valve seat 146 formed on the second piston portion 134 by the elastic force of the arms 144. Thus, the valve seat 146 is sealed with the valve plug 142 of the secondary valve 140. Since the arms 144 extend circumferentially, however, the valve plug 142 can move along the axis of the piston 118 so as to be removed from the valve seat 146.

When the valve plug 142 is removed from the valve seat 146 by the pressurized liquid, it abuts against a spinner 148 (see FIG. 16) at the back of the nozzle 128. When the valve plug 142 is not in contact with the spinner 148, tangential passages 150 of the spinner 148 are open at the back, so that the spinner 148 cannot fulfill its function. When the valve plug 142 abuts against the spinner 148, however, the passages 150 are closed at the back, so that the spinner 148 can fulfill its function. Thus, the pressurized liquid is swirled by the passages 150.

A valve rod 152 is disposed unfixed in the cylinder 116. As seen from FIG. 17, the valve rod 152 is formed of a pair of conical end portions 154 and 156, a square portion 158 coupled to the end portion 154, a large-diameter column portion 160 having a slanted shoulder portion 159 and coupled to the square portion 158, and a small-diameter column portion 162 between the large-diameter column portion 160 and the end portion 156. A rounded shoulder portion 164 is formed at the junction of the end portion 154 and the square portion 158, while a vertical shoulder portion 166 is formed at the junction of the small-diameter column portion 162 and the end portion 156. The shoulder portion 164 can engage four projections 168 formed on the inner surface of the second piston portion 134, while the shoulder portion 166 can abut against ribs 170 radially protruding from the inner surface of the cylinder 116. Also, the shoulder portion 159 of the large-diameter column portion 160 can engage a shoulder portion 172 formed on the inner surface of the cylinder 116. When engaged, the shoulder portions 159 and 160 form a primary valve 173. The projections 168 can be in contact with the side faces of the square portion 158.

The piston 118 is biased in its projecting direction by a compression coil spring 174 in the cylinder 116. Thus, the piston 118 is kept in a position such that the length of spring 174 is free. An engaging portion 176 is formed at the free end of the trigger 126. A support bar 180 is attached to the cylinder 116 by means of a hinge 178, and a mating portion 182 capable of engaging the engaging portion 176 is formed at the tip of the support bar 180. A part 184 of the mating portion 182 can engage an engaging recess 186 formed in the wall of the container 112.

Figure 18:
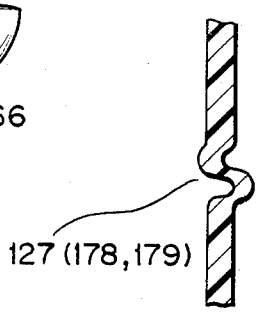
FIG. 18 is a sectional view showing a modification of a hinge.

The nozzle 128 is coupled to the trigger 126 by means of a hinge 179 on the lower edge of the nozzle 128, and a slit 181 is formed at the upper edge portion. The hinge 179 and the slit 181 act so that the piston 118 can move along the axis of the cylinder 116 without rocking around the hinge 127 when the trigger 126 is rocked around the hinge 127. The hinges 127, 178 and 179 are not limited to the illustrated form, and may be in any other form that permits the desired actions. As shown in FIG. 18, for example, each of these hinges may be formed of an S-shaped, thin-walled portion.

The sprayer 110 of the aforementioned construction is operated in the following manner.

During transportation or on display in a shopwindow, the engaging portion 176 of the trigger 126 is in engagement with the mating portion 182 of the support bar 180, as shown in FIG. 14. In this state, if an urging force to rock the trigger 126 clockwise around the hinge 127 is applied to the trigger 126, it is inclined to rock along a circular arc 190 shown in FIG. 14. However, the support bar 180 is allowed only to rock along a circular arc 192 around the hinge 178. Therefore, the support bar 180 cannot rock even though the trigger 126 is subjected to the aforesaid urging force. Thus, when the engaging portions 176 and 182 are engaged, no urging force can rock the trigger 126. Accordingly, the trigger 126 will never carelessly be rocked, so that unwanted spraying will securely be avoided. Namely, the support bar 180 constitutes a child-proof mechanism.

Figure 20:
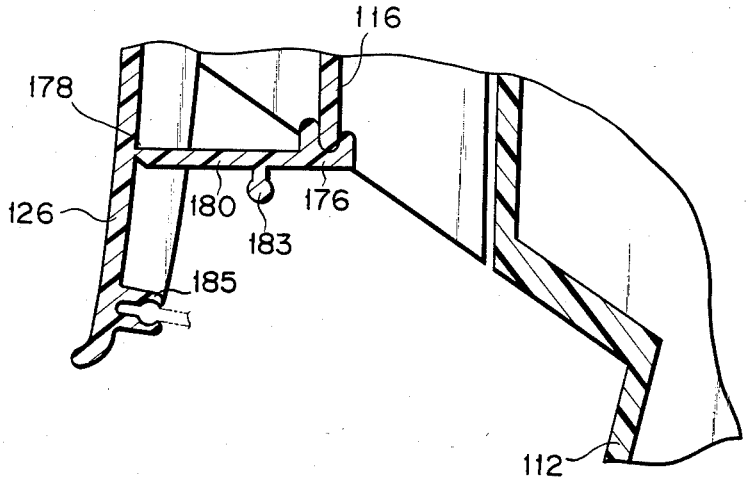
FIG. 20 is a sectional view showing a modification of a child-proof mechanism.

In this second embodiment, the child-proof mechanism is formed integrally with the pump mechanism 114, ensuring a very simple structure. It is to be understood that the child-proof mechanism not only serves as a virgin lock, but also can be used when the spraying operating is suspended. As shown as a modification in FIG. 20, the child-proof mechanism may be designated so that the support bar 180 is attached to the trigger 126 by means of the hinge 178. In the modification of FIG. 20, the engaging portion 176 of the support bar 180 can engage the cylinder 116. In use, another engaging portion 183 of the support bar 180 is coupled to a mating portion 185 of the trigger 126.

Figure 19:
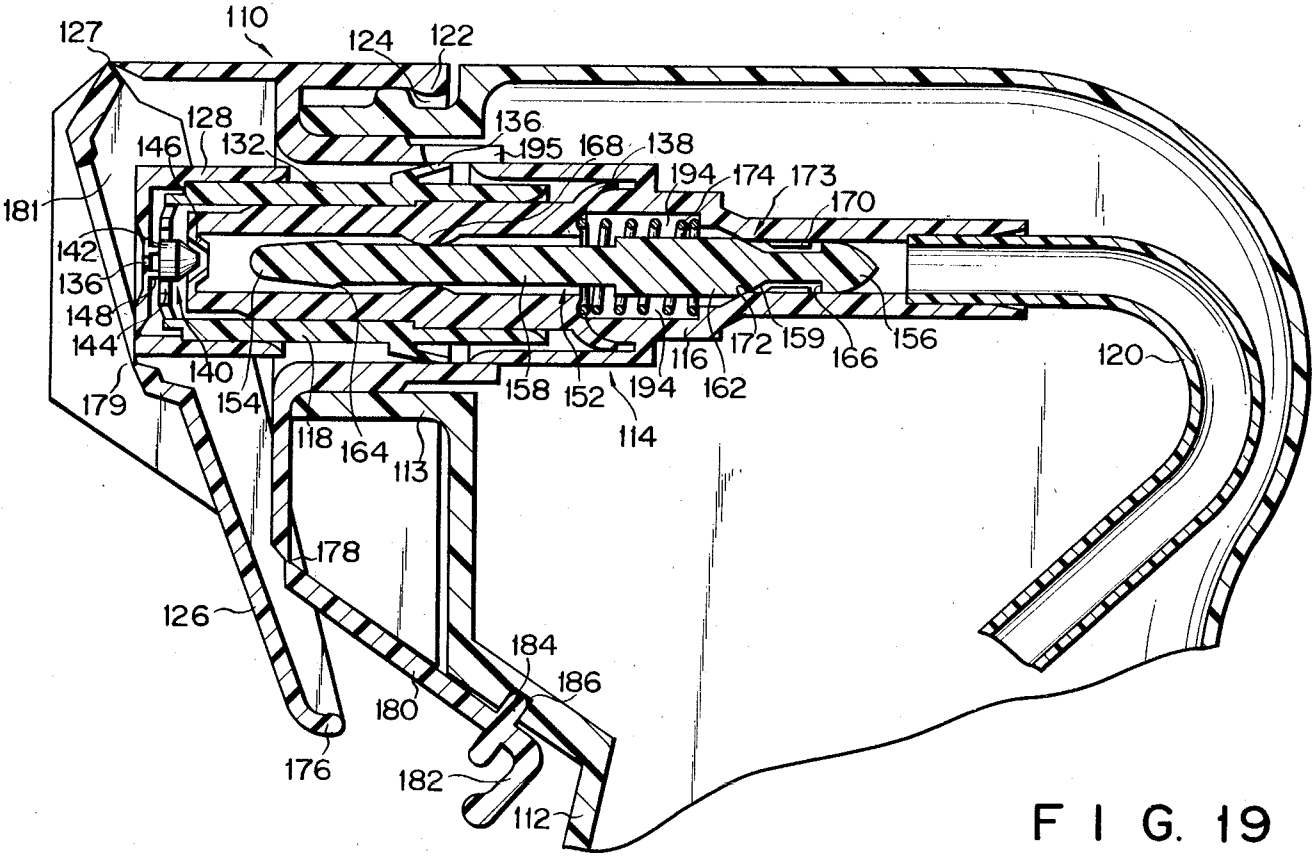

In use, the mating portion 182 is disengaged from the engaging portion 176, and the support bar 180 is rocked counterclockwise around the hinge 178 so that the part 184 is fitted and locked in the engaging recess 186 of the container 112, as shown in FIG. 19. Locked in this manner, the support bar 180 will never prevent the trigger 126 from rocking. If the trigger 126 is pulled, it is rocked around the hinge 127 against the urging force of the spring 174. As the trigger 126 is rocked, the piston 116 is forced into the cylinder 118, so that the capacity of the chamber 194 in the cylinder 116 is reduced. In this case, the piston 118 is forced into the cylinder 116 without rocking around the hinge 127 owing to the existance of the hinge 179 and the slit 181. If the urging force on the trigger 126 is removed thereafter, the piston 118 and the trigger 126 are returned to their respective initial positions shown in FIG. 14 by the biasing force of the spring 174. As a result, the capacity of the chamber 194 increases, so that a negative pressure is produced in the chamber 194.

As the piston 118 returns to its initial position, the projections 168 of the second piston portion 134 engage the shoulder portion 164 of the valve rod 152 to move the valve rod 152 together with the piston 118, thereby separating the shoulder portion 159 of the valve rod 152 from the shoulder portion 172 of the cylinder 116. Thus, the primary valve 173 is opened, so that the liquid in the container 112 is caused to flow into the chamber 194 through the suction tube 120 and the primary valve 173 by the negative pressure in the chamber 194. The secondary valve 140 is kept fully liquid-tight, since it is closed by the biasing force of the arms 144 as well as the negative pressure in the chamber 194. As the liquid is sucked up into the chamber 194 through the suction tube 120, the liquid remaining in the container 112 is decreased, possibly producing a negative pressure in the container 112. When the piston 118 is forced into the cylinder 116, however, the sealing skirt 136 goes beyond a negative pressure preventing hole 195 of the cylinder 116, as shown in FIG. 19. Thus, the interior of the container 112 communicates with the outside air by means of the negative pressure preventing hole 195, thereby preventing the production of a negative pressure in the container 112.

Thereafter, if the trigger 126 is rocked again in the counterclockwise direction around the hinge 127, the projections 168 of the second piston portion 134 move in contact with the side faces of the square portion 158 of the valve rod 152. Accordingly, the valve rod 152 is moved together with the trigger 126 and the piston 118 by the frictional force between the projections 168 and the square portion 158, so that the shoulder portion 159 abuts against the shoulder portion 172 to close the primary valve 173. As the trigger 126 is further rocked thereafter, the piston 118 goes deeper into the cylinder 116 to pressurize the liquid in the chamber 194. When the pressure of the pressurized liquid surpasses the biasing force of the arms 144 of the secondary valve 140, the valve plug 142 is removed from the valve seat 146 to open the secondary valve 140. Thereupon, the valve plug 142 abuts against the back of the spinner 148 to close the back of the tangential passages 150 (FIG. 14). Therefore, the pressurized liquid flowing out through the secondary valve 140 flows into the passages 150 to be swirled thereby. Then, the swirled liquid is sprayed through the orifice 136. Thereafter, when the urging force on the trigger 126 is removed, the liquid in the container 112 is sucked up into the chamber 194 for the next cycle of spraying operation. The next cycle is started by pulling the trigger 126.

The sprayer 110 of the second embodiment can be used as a dispenser if the spinner 148 is removed therefrom. It can also be used as a foamer whereby the liquid swirled and sprayed through the orifice 136 is dashed against foaming means such as a barrier to be foamed thereon. Moreover, the sprayer 110 may have a construction such that the pump mechanism 114 is attached to not the lateral but the top of the container 112 so that the piston 118 is reciprocated vertically.

According to the second embodiment, as described above, a cylinder is provided with an engaging portion at the middle portion thereof to be coupled to a container, a suction tube mounting portion at one end portion, and a trigger at the other end portion, and a nozzle is formed integrally on the trigger. With this arrangement, the second embodiment may produce the same effect of the foregoing first embodiment.

What is claimed is:

1. A trigger-type sprayer which sucks up, pressurizes and sprays a liquid contained in a container having a mouth portion, the sprayer comprising:

a housing attached to the mouth portion of the container;

a trigger rockably attached to one end portion of the housing and integrally formed with the housing in one piece;

a nozzle formed on the trigger, said nozzle being integrally formed with the trigger in one piece and having an orifice;

a cylinder supported at the middle portion on the housing, said cylinder being integrally formed with the housing in one piece and having opposite end portions, one end portion being capable of facing the orifice;

a suction tube attached to the other end portion of the cylinder and connecting the interior of the cylinder with the interior of the container;

a hollow piston one end of which is connected to the nozzle and the other end of which is slidably located in the cylinder, said piston being in slidable contact with the inner surface of the cylinder; and valve means adapted to close and open the nozzle and the suction tube, respectively, when the trigger is rocked in one direction relative to the housing, and to open and close the nozzle and the suction tube when the trigger is rocked in the other direction relative to the housing.

2. The trigger-type sprayer according to claim 1, wherein said trigger is rockably attached to the housing by means of a hinge, and said nozzle is rockably attached to the trigger by means of another hinge.

3. The trigger-type sprayer according to claim 2, wherein said one end of the piston is fixed to the nozzle, and the other end of the piston has a through hole opening into the cylinder.

4. The trigger-type sprayer according to claim 3, wherein said valve means includes a primary valve for selectively connecting the suction tube and the cylinder, and a secondary valve for selectively connecting the cylinder and the piston.

5. The trigger-type sprayer according to claim 4, wherein said primary and secondary valves are separately formed.

6. The trigger-type sprayer according to claim 5, wherein said secondary valve includes a secondary valve plug capable of blocking said through hole, and a second urging member in the piston for urging the secondary valve plug in a direction such that the secondary valve plug blocks the through hole.

7. The trigger-type sprayer according to claim 6, wherein said secondary valve plug and said second urging member are integrally formed as one piece.

8. The trigger-type sprayer according to claim 5, wherein said primary valve includes a primary valve plug capable of blocking said suction tube, and a first urging member in the cylinder for urging the primary valve plug in a direction such that the primary valve plug blocks the suction tube.

9. The trigger-type sprayer according to claim 8, wherein said primary valve plug and said first urging member are integrally formed as one piece.

10. The trigger-type sprayer according to claim 2, wherein said piston includes a first piston portion one end of which is connected to the nozzle, and a second piston portion one end portion of which is inserted in the first piston portion and the other end portion of which is in sliding contact with the inner surface of the cylinder.

11. The trigger-type sprayer according to claim 10, wherein said one end portion of the first piston portion is open, and a valve seat is formed at said one end portion of the second piston portion.

12. The trigger-type sprayer according to claim 11, wherein said valve means includes a primary valve for selectively connecting the suction tube and the cylinder, and a secondary valve for selectively connecting the second piston portion and the nozzle.

13. The trigger-type sprayer according to claim 12, wherein said primary and secondary valves are separately formed.

14. The trigger-type sprayer according to claim 13, wherein said secondary valve is attached to the one end portion of the first piston portion, and includes a secondary valve plug capable of blocking the valve seat and a second urging member for urging the secondary valve plug in a direction such that the secondary valve plug comes closely into contact with the valve seat.

15. The trigger-type sprayer according to claim 14, wherein said secondary valve is formed as one piece integrally with the first piston portion.

16. A trigger-type sprayer comprising:

a container having a substantially vertical lateral face, and a mouth portion attached to said substantially vertical lateral face, said mouth portion extending in a substantially horizontal direction; and a pump mechanism which is attached to the container, and sucks up, pressurizes and sprays a liquid contained in the container, said pump mechanism including:

a housing attached to the mouth portion of the container, a trigger rockably attached to one end portion of the housing and integrally formed with the housing in one piece, a nozzle formed on the trigger, said nozzle being integrally formed with the trigger in one piece and having an orifice, a cylinder supported at the middle portion of the housing, said cylinder being integrally formed with the housing in one piece and having opposite end portions, one end portion being capable of facing the orifice, a suction tube attached to the other end portion of the cylinder and connecting the interior of the cylinder with the interior of the container, a piston one end of which is connected to the nozzle and the other end of which is slidably located in the cylinder, said piston being in sliding contact with the inner surface of the cylinder, and valve means adapted to close and open the nozzle and the suction tube, respectively, when the trigger is rocked in one direction relative to the housing, and to open and close the nozzle and the suction tube when the trigger is rocked in the other direction relative to the housing.

17. The trigger-type sprayer according to claim 16, wherein said trigger is rockably attached to the housing by means of a hinge, and said nozzle is rockably attached to the trigger by means of another hinge.

18. The trigger-type sprayer according to claim 17, wherein said one end of the piston is fixed to the nozzle, and the other end of the piston has a through hole opening into the cylinder.

19. The trigger-type sprayer according to claim 18, wherein said valve means includes a primary valve for selectively connecting the suction tube and the cylinder, and a secondary valve for selectively connecting the cylinder and the piston.

20. The trigger-type sprayer according to claim 19, wherein said primary and secondary valves are separately formed.

21. The trigger-type sprayer according to claim 5, wherein said secondary valve includes a secondary valve plug capable of blocking said through hole, and a second urging member in the piston for urging the secondary valve plug in a direction such that the secondary valve plug blocks the through hole.

22. The trigger-type sprayer according to claim 21, wherein said secondary valve plug and said second urging member are integrally formed as one piece.

23. The trigger-type sprayer according to claim 20, wherein said primary valve includes a primary valve plug capable of blocking said suction tube, and a first urging member in the cylinder for urging the primary valve plug in a direction such that the primary valve plug blocks the suction tube.

24. The trigger-type sprayer according to claim 23, wherein said primary valve plug and said first urging member are integrally formed as one piece.

25. The trigger-type sprayer according to claim 17, wherein said piston includes a first piston portion one end of which is connected to the nozzle, and a second piston portion one end portion of which is inserted in the first piston portion and the other end portion of which is in sliding contact with the inner surface of the cylinder.

26. The trigger-type sprayer according to claim 25, wherein said one end portion of the first piston portion is open, and a valve seat is formed at said one end portion of the second piston portion.

27. The trigger-type sprayer according to claim 26, wherein said valve means includes a primary valve for selectively connecting the suction tube and the cylinder, and a secondary valve for selectively connecting the second piston portion and the nozzle.

28. The trigger-type sprayer according to claim 27, wherein said primary and secondary valves are separately formed.

29. The trigger-type sprayer according to claim 28, wherein said secondary valve is attached to the one end portion of the first piston portion, and includes a secondary valve plug capable of blocking the valve seat and a second urging member for urging the secondary valve plug in a direction such that the secondary valve plug comes closely into contact with the valve seat.

30. The trigger-type sprayer according to claim 29, wherein said secondary valve is formed integrally with the first piston portion as one piece.

31. The trigger-type sprayer according to claim 1, wherein said nozzle is rockably attached to the trigger.

32. The trigger-type sprayer according to claim 16, wherein said nozzle is rockably attached to the trigger.

* * * * *